United States Patent [19]

Corbo et al.

[11] Patent Number: 4,854,060

[45] Date of Patent: Aug. 8, 1989

[54] SELF-ERECTING PHOTO DISPLAY

[75] Inventors: Thomas E. Corbo, Gates Mills; Richard J. Cisek, Jr., Lagrange; Kathryn M. Matthews, Westlake; George K. Sehringer, Rocky River, all of Ohio

[73] Assignee: Manco Inc., Cleveland, Ohio

[21] Appl. No.: 198,603

[22] Filed: May 6, 1988

Related U.S. Application Data

[63] Continuation of Ser. No. 19,659, Feb. 27, 1987, abandoned.

[51] Int. Cl.[4] ..... A47G 1/06; G09F 1/12

[52] U.S. Cl. ..... 40/152.1; 40/155; 40/539

[58] Field of Search ..... 40/124.1, 152, 152.1, 40/155, 538, 539, 540; 206/805; 229/8, 922; 478/7, 12

[56] References Cited

U.S. PATENT DOCUMENTS

| | | | |
|---|---|---|---|
| 651,043 | 6/1900 | Kent | 40/158 R |
| 990,918 | 5/1911 | Stadler | 446/148 |
| 1,028,147 | 6/1912 | Stranders | 40/539 |
| 2,153,460 | 4/1939 | Giles | 40/124.1 |
| 2,312,644 | 3/1943 | Horr | 40/154 |
| 2,332,642 | 10/1943 | Johnson | 40/154 |
| 2,373,074 | 3/1945 | Ziemmerman | 40/154 |
| 2,601,374 | 6/1952 | Ditzler | 40/126 |
| 2,731,748 | 1/1956 | Polay | 40/155 |
| 2,833,074 | 5/1958 | Jannes | 40/539 |
| 3,021,042 | 2/1962 | Stumpf, Jr. | 206/805 |
| 3,267,597 | 8/1966 | Jannes | 40/126 |
| 3,775,884 | 12/1973 | Smith | 40/124.1 |
| 4,309,835 | 1/1982 | Naeve | 40/310 |
| 4,365,432 | 12/1982 | McCauley et al. | 40/365 |
| 4,619,426 | 10/1986 | Drueck, Jr. | 206/805 |

*Primary Examiner*—Gene Mancene
*Assistant Examiner*—Michael Lynch
*Attorney Agent, or Firm*—Body, Vickers & Daniels

[57] ABSTRACT

A collapsible, self-erecting photo display stand is disclosed which can be easily collapsed into a folded configuration and shipped in a flat envelope but will spring into an erected box-like configuration upon removal from the envelope. The device is fabricated by die-cutting and scoring of a sheet of material from a single side into a number of panels and margins which are glued into a novel arrangement. L-shaped margins provide the interconnection between adjacent panels which encourages self-erection to stiffen the finished display.

1 Claim, 6 Drawing Sheets

152
A
72
70
54
50
110
112
71
14
124
120
51
13
21
152
122
82
114
118
116
10
80
152
43
12
91
152
20
22
53
11
31
81
44
61
134
138
90
23
94
170
152
30
136
132
64
140
102
144
152
4
42
142
130
62
40
32
152
41
101
33
32
60
63
152
104
103
100

B
21
13
12
72
14
70
74
71
51
73
10
82
80
84
83
81
61
152
54
110
112
50
120
124
116
122
118
92
114
44
43
11
40
152
130
60
102
134
42
62
132
140
136
144
142
138
53
90
91
93
94
41
33
104
103
63
100
101

B
152
13
21
82
22
80
20
83
81
84
61
31
23
32
60
30
50
62
64
52
34
72
24
70
74
73
71
51
54
63
33
41
53

SELF-ERECTING PHOTO DISPLAY

This is a continuation of Ser. No. 019,659 filed Feb. 27, 1987, now abandoned.

BACKGROUND OF THE INVENTION

1. Field Of The Invention

The present invention relates to collapsible display devices and more particularly to a novel display device which can easily be disposed in a flattened position but will assume an upright box-like position when not otherwise restrained.

2. Brief Description Of The Prior Art

Display stands for photographs, with the photographs in place, are often used as gifts. For instance, parents of young children will assemble selected photographs of these children, mount them on a display and send the display with the photographs to their own parents. Such gifts are commonly sent during the holiday season and are also often requested at other times by grandparents desiring to display photos of their grandchildren in their own homes. Photo display stands for use in the above described application and other applications in the past have taken the form of heavy rigid frames supporting boards and protective glass or photo cubes. Photo cubes are often plastic devices have apertures for receiving photographs of a given size and displaying these photographs on the various sides of the cube. They are not actually cubic but are rectangular cuboids. Both framed photo displays and photo cubes have serious drawbacks related to shipping. Thus, a picture frame having a board and protective glass is heavy and fragile. It is therefore expensive to ship and likely to break in transit. Photo cubes are bulky. They occupy much space and are therefore expensive and difficult to package and ship. Moreover, both heavy picture frames and photo cubes are relatively expensive articles.

Attempts have been made in the past to provide less expensive and more easily shipped display means. These attempts have been primarily confined to advertising display means used in commercial settings where the display message can be printed on the display structure itself and the structure can be flattened by skilled workers capable of performing complex operations before insertion in an envelope for shipping. U.S. Pat. Nos. 3,267,597; 4,309,835; 2,731,748; 3,775,884; 1,028,147; 990,918; 4,365,432; 2,153,460: 2,601,374; 2,373,074; 2,332,642; and 2,312,644 describe such collapsible displays.

Some of these displays, such as Stadler U.S. Pat. No. 990,918 and Ditzler et al U.S. Pat. No. 2,601,374 show rectangular displays which are self-erecting into a rectangular disposition from a flat disposition. However, Stadler requires a somewhat complex folding operation not easily mastered by a consumer and Ditzler is only a three-sided display not having a back. Thus, an inexpensive, self-erecting, easily flattened, consumer oriented photo display stand has not existed in the past.

SUMMARY OF THE INVENTION

The present invention contemplates a new and improved display stand which is inexpensive to produce, self-biasing into an upright display configuration, easily flattened and inserted into an envelope, and into which photographs may be easily inserted.

In accordance with the present invention, there is provided a photo display stand fabricated of sheet material in a unique configuration and biased by an internally concealed elastic band. The display stand assumes a rectangular box-like cuboid configuration when unrestrained but is easily pressed into a flat sheet-like planar configuration whereby the display stand may be easily placed in an envelope for shipping and/or storage.

In accordance with the invention, a device is provided comprised of thin flat sheet material scored, folded and glued to have six major panels interconnected to one another and connected to several marginal panels. Four of the major panels are identical in shape and size. The remaining two major panels are identical square panels. The major panels are interconnected such that two rectangular panels and two square panels form a continuous band interconnected by fold lines. The two remaining rectangular panels are connected to the opposite sides of one of the rectangular panels in the continuous band. L-shaped margins interconnect the tops and bottoms of the two rectangular panels not in the continuous band to the square panels such that when the two rectangular panels are pulled together from the planar configuration into a parallel configuration forming two sides of a cuboid, the L-shaped margins force the continuous band to rise from the planar configuration into a configuration completing the cuboid.

Further in accordance with the invention, the L-shaped margins interconnecting the non-band rectangular panels and the square panels are provided with slits across a portion of the apex of the L-shaped margins.

Yet further in accordance with the invention, the segments of the L-shaped margins connected to the bottoms of the non-band rectangular panels are adhesively bonded to the inside surfaces of the non-band rectangular panels.

Still further in accordance with the invention, triangular portions of sheet material are cut out of each L-shaped margin at the vertex, that is, the point closest to the junction of the non-band panels and the band panels.

Still further in accordance with the invention, elastic band attachment panels are provided on the sides of the non-band rectangular panels not connected to the band panels, such marginal panels having a portion adhesively bonded to the non-band rectangular panels and hook-like portions providing interconnection points for an elastic band.

Yet further in accordance with the invention, several of the panels are provided with die-cut slits at their four corners spaced to accept the four corners of a photograph thereby retaining the photograph in mounted position on the panel without the need of adhesive bonding.

Still further in accordance with the invention, the foldable joints betweeen panels are provided by die-cutting partially through the sheet material to form scored lines or by sliting all the way through the sheet material on a portion of the fold line only. The scored lines are all cut in the finished side of the sheet material only and cutting also takes place from the finished side.

The principal object of the invention is to provide a novel, self-erecting and easily flattened photo cube.

Another object of the present invention is to provide a photo cube which may be easily loaded with photos and placed into an envelope by the consumer for mailing without the need for special packaging.

Yet another object of the present invention is the provision of a photo cube which is fabricated from a single sheet in die-cutting operations on a single side of said sheet, such single side also being the side upon which finished printing is placed, if desired.

Still another object of the present invention is the provision of a collapsible photo cube which is inexpensive to manufacture and ship yet will provide a high quality, easily used photo display means for use by consumers.

The invention may take physical form in certain parts and arrangements of parts, a preferred embodiment of which will be described in detail in this specification and illustrated in the accompanying drawings which form a part hereof and wherein.

Figure 1:
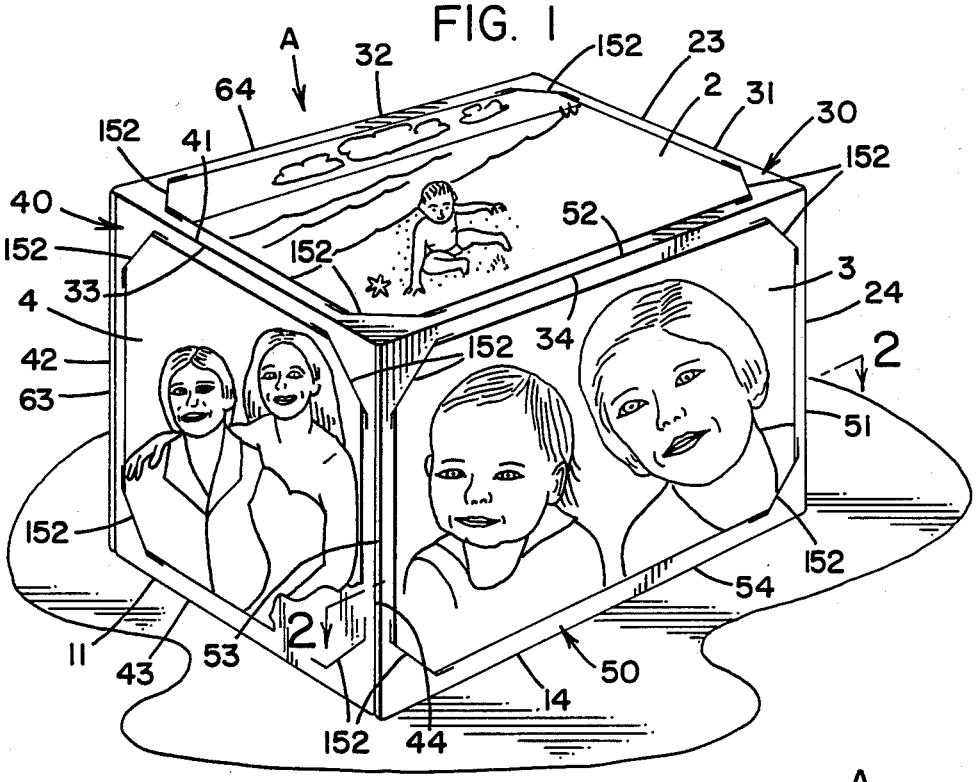
FIG. 1 is a perspective view of an assembled display constructed in accordance with the invention with photographs displayed on selected faces of the display.

Referring now to the drawings wherein the showings are for the purpose of illustrating the preferred embodiment of the invention only and not for the purposes of limiting same, the figures show a cuboid photo display A seen as displayed in FIG. 1. The photo display is adapted to support and display a number of photographs 2, 3, 4 for easy viewing on a desk, mantel piece or the like.

Figure 9:
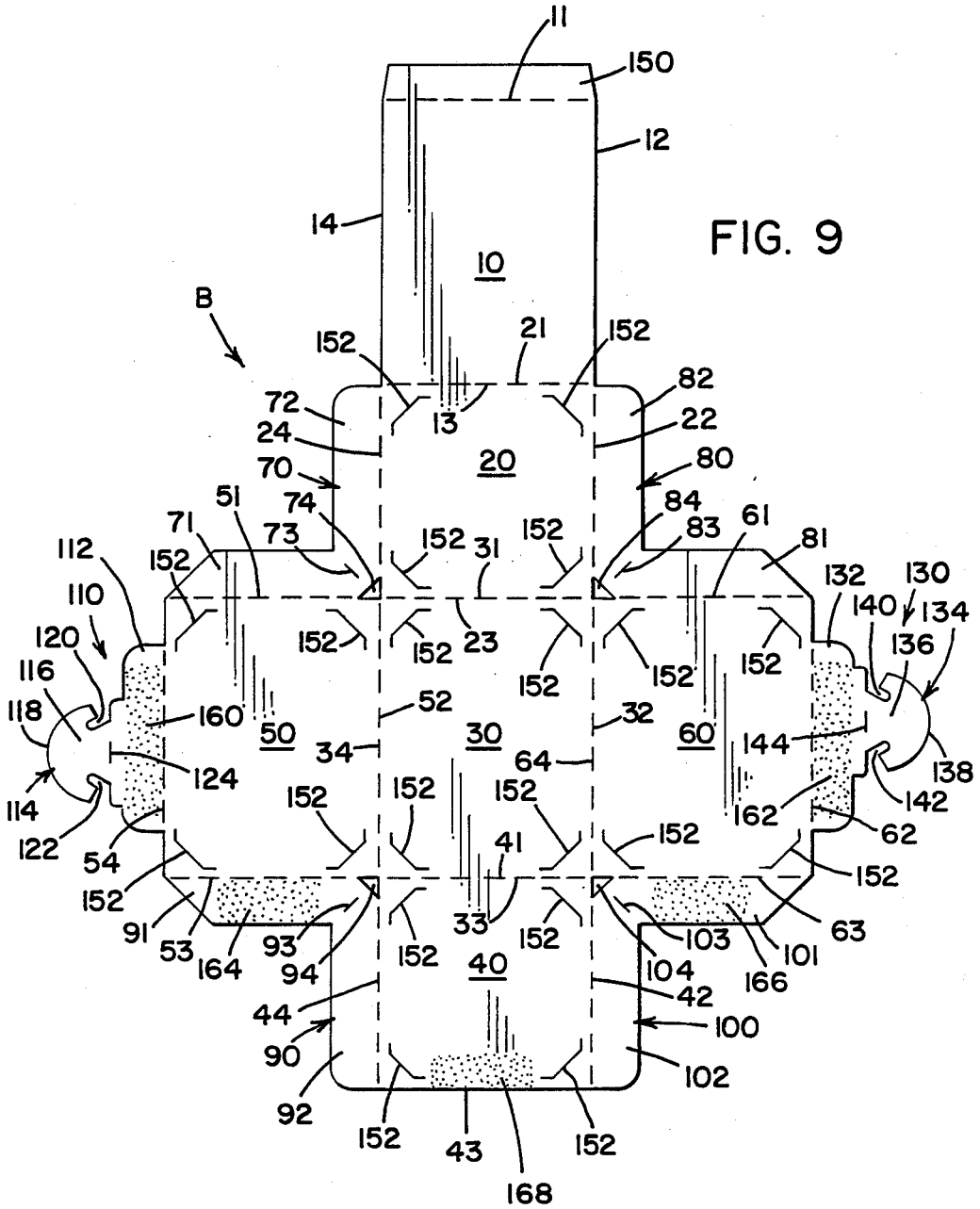
FIG. 9 is a planar view of the sheet of material from which the device is constructed prior to folding and adhesive bonding but subsequent to die-cutting and application of adhesive.

The photo display A is constructed from thin, somewhat stiff, sheet material such as paperboard or the like. The paperboard may be finished on one side and printed with a border if so desired. The paperboard is first die-cut into a blank B best seen in FIG. 9. The blank B is shown in FIG. 9 in the planar position with its unfinished surface facing upwardly. The die-cutting operation cuts the blank to shape as seen in FIG. 9 and also scores the blank providing line upon which the blank B may be easily folded. Score lines are shown as dashed lines in the drawing although they are continuous in practice. The score lines are all made on the finished side of the blank B, that is, the underside of the blank as seen in FIG. 9. The die-cutting operation results in the blank B being divided into six rectangular panels, four marginal panels, hereinafter referred to as margins, and several miscellaneous shapes all continuously connected to one another in the paperboard blank B. Rectangular panels 10, 20, 30, 40 are disposed in a vertical column or band. Rectangular panel 10, the upper band panel, has four straight edges, a top edge 11, a right edge 12, a bottom edge 13 and a left edge 14. Similarly, panel 20 has a top edge 21, a right edge 22, a bottom edge 23 and a left edge 24. Rectangular panel 30 has four similarly identified edges 31, 32, 33 and 34. Lower band panel 40 also has four similar edges 41, 42, 43 and 44.

The panels 10, 20, 30 and 40 are connected to one another by score lines forming the top and bottom edges of adjacent panels. Thus, the bottom edge 13 of panel 10 is connected to the top edge 21 of panel 20; the bottom edge 23 of panel 20 is connected to the top edge 31 of panel 30; and the bottom edge 33 of panel 30 is connected to the top edge 41 of panel 40. Each of these connections is foldable but continuous over the top and bottom edges of the panels involved.

A left side panel 50 is provided having a top edge 51, a right edge 52, a bottom edge 53 and a left edge 54. The left side panel 50 is terminated by a score line along its right edge which also forms the left edge 34 of panel 30. A right side panel 60 is provided with a top edge 61, a right edge 62, a bottom edge 63 and a left edge 64. The left edge 64 of right side panel 60 is joined along its entire length of the right edge 32 of panel 30.

Thus, six panels are arranged with four panels 10, 20, 30, 40 in a vertical column. The side panels 50, 60 are also connected to panel 20, the panel disposed above panel 30, and panel 40, the panel disposed below panel 30 through several marginal panels, referred to hereinafter as margins. Left upper margin 70 connects left panel 50 to panel 20. The left upper margin 70 is shaped like a reversed "L" with the horizontal segment 71 of the "L" foldably connected to the top edge of the left panel 50 and the vertical segment 72 of the "L" foldably connected to the left edge 24 of the panel 20. The connections of both the horizontal segment 71 and the vertical segment 72 are made upon score lines so that foldability is assured. The two segments 71, 72 of the L-shaped margin 70 are interconnected by continuous sheet material having two features die-cut therein. A slit 73 is cut along a portion of the line originating at the junction of margin 70, panel 20, panel 30 and panel 50. The line of the slit 73 is at an angle of 45° with both the left edge 24 of the panel 20 and the top edge 51 of the panel 50. The slit 73 cuts through only a portion of the line connecting the vertical segment 72 and the horizontal segment 71 of the margin 70. Additionally, a triangular aperture 74 is provided by cutting away a portion of paperboard at the vertex in the L-shaped margin 70, that is, at the point where the top edge 51 of right side panel 50 and the left edge 24 of panel 20 meet.

A right upper margin 80 is provided connecting the right side panel 60 to the upper band panel 20. Right upper margin 80 is a mirror image reflection of left upper margin 70 and is identical to margin 70 in all other respects. It, too, is comprised of a lower horizontal segment 81, a vertical segment 82, and has a slit 83 and triangular aperture 84 at the vertex of the L-shaped margin.

The left hand panel 50 is joined to the lower band panel 40 by a third L-shaped margin 90 also having a horizontal segment 91, a vertical segment 92, a vertex slit 93 and a triangular aperture 94. The right side panel 60 is joined to lower band panel 40 by a fourth margin 100 also having a horizontal segment 101, a vertical segment 102, a vertex slit 93, and a triangular aperture 94. All four margins, 70, 80, 90, 100 are identical in size and shape and are merely rotated with respect to one another to interconnect the panels recited.

A left elastic band attachment 100 is foldably connected along the left edge 54 of the left side panel 50. The left elastic band attachment 110 is comprised of an adhesive receiving panel 112 and a hook panel 114 comprised of a central base 116, an outwardly facing arcuate edge 118 and two undercut recesses 120, 122 which will retain an elastic band tensioned away from the base 116 and over the arcuate edge 118 of the band attachment structure 110. A slit 124 extends partially across the base of the hook panel 114 forming a foldable hinge between the hook panel 114 and the adhesive retaining panel 112.

A right elastic band attachment 130 extends from the right edge 62 of the right side panel 60. It is functionally identical to the left elastic band attachment 110 having an adhesive receiving panel 132, a hook panel 134, a central base 136, an arcuate edge 138, and undercut recesses 141, 142 arranged as in the left side elastic band attachment. Additionally, a slit 144 is provided in the central portion of the line connecting the base 136 of the hook panel 134 to the adhesive receiving panel 132. This slit 144 makes the joint between the base 136 and the adhesive receiving panel 132 a foldable hinge capable of folding in either direction.

The right hook panel 134 is disposed slightly above the left hook panel 114 but is otherwise identical to it.

A band attachment panel 150 is connected to the top edge 11 of the upper band panel 10. The band attachment panel 150 is separated from the upper band panel 10 by a score line along the top edge 11.

Photo retaining slits 152 are provided at the four corners of selected rectangular panels. Each of the slits 152 is comprised of a long central portion angled at 45° to the sides of rectangular panel involved and two end portions parallel to the adjacent edge connected to the two ends of the central portion of the slit. With such slits in the four corners of a panel, it is an easy matter to tuck the four corners of a photo into the slits, thereby retaining the photo on the panel.

The embodiment of the invention illustrated shows the slits on the three band panels 20, 30, 40 and the two side panels 50, 60. Of course, slits can be provided on all the panels or on only selected panels as desired.

All of the elements and interconnections thus far described are created by die-cutting and die-scoring a single piece of paperboard. Moreover, all of the score lines are in a single side of the paperboard blank B, thus requiring the scoring of only one side of the blank B. All of the folds promoted by the score lines are in the same direction in the invention described. Folds in the other direction are promoted by means of a slit all the way through the paperboard along a portion of the fold line. Moreover, all of the score lines and edges thus far described are created by scoring along a limited number of continuous lines. Thus, the top edges of panels 50, 30 and 60 form a continuous line identified as to top edges 51, 31 and 61. Economy of manufacture is thereby facilitated.

Figure 7:
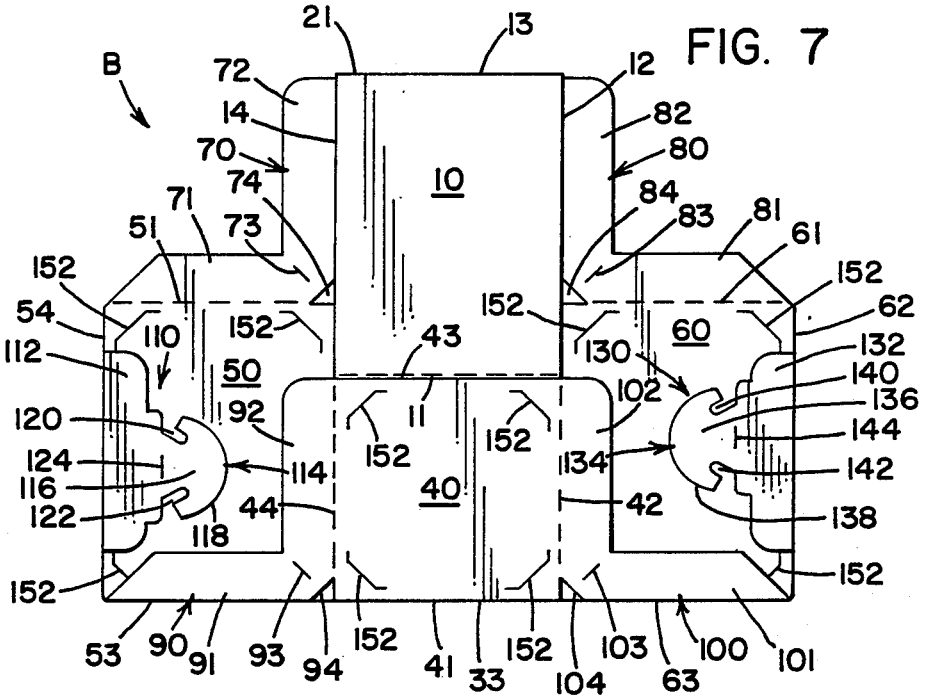
FIG. 7 is a planar view of the display device before assembly of the elastic band biasing means and the application of photographs to the device.
Figure 8:
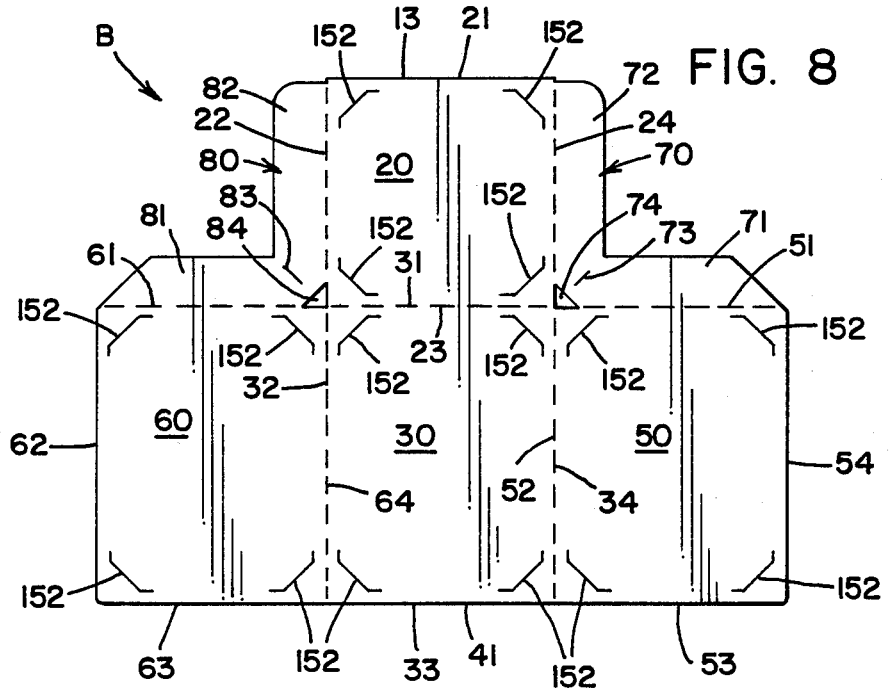
FIG. 8 is a planar view of the back of the device of FIG. 7.

Still referring to FIG. 9, adhesive 160, 162 is applied to the adhesive receiving panels 112, 132 of both the left elastic band attachment 110 and the right elastic band attachment 130. Adhesive 164, 166, 168 is also applied to the horizontal segment 91 of the left lower margin 90, the horizontal segment 101 of the right lower margin 100 and the area of the lower band panel 40 adjacent its bottom edge 43. The blank B is then folded along the bottom edge 13 of upper band panel 10 bringing the upper band panel 10 into facing contact with the band panels 20 and 30. Lower band panel 40 and the adjacent margins 90 and 100 are also folded over bringing the adhesive 168 adjacent the bottom edge of the lower band panel 40 into contact with the band attachment panel 150 and also bringing the adhesive 164, 166 on the margins 90 and 100 into contact with adjacent areas on the panels 50 and 60. This results in a tight adhesive bond between the areas in question. Left elastic band attachment 110 and right elastic band attachment 130 are both also folded over along the edges of the panels to which they are attached. This results in the adhesive 160, 162 on the adhesive receiving panels 112 and 132 engaging the panels 50, 60 and forming a tight attachment. The hook panels 114 and 134, while lying against the respective panels 50, 60, are not adhesively fixed in place but are free to fold around the slits 124, 144. The blank B in its folded configuration is shown in FIG. 7, and flipped over after the fold in FIG. 8. It can be seen from FIGS. 7 and 8 that end panels 10, 20, 30, 40 form a continuous band of four panels each joined to the adjacent panels at their top and bottom edges. As the paperboard used to fabricate the blank B is stiff, the blank B will fold easily along the edges of the panels only and along those areas within the margins having slits to promote folding only.

Figure 6:
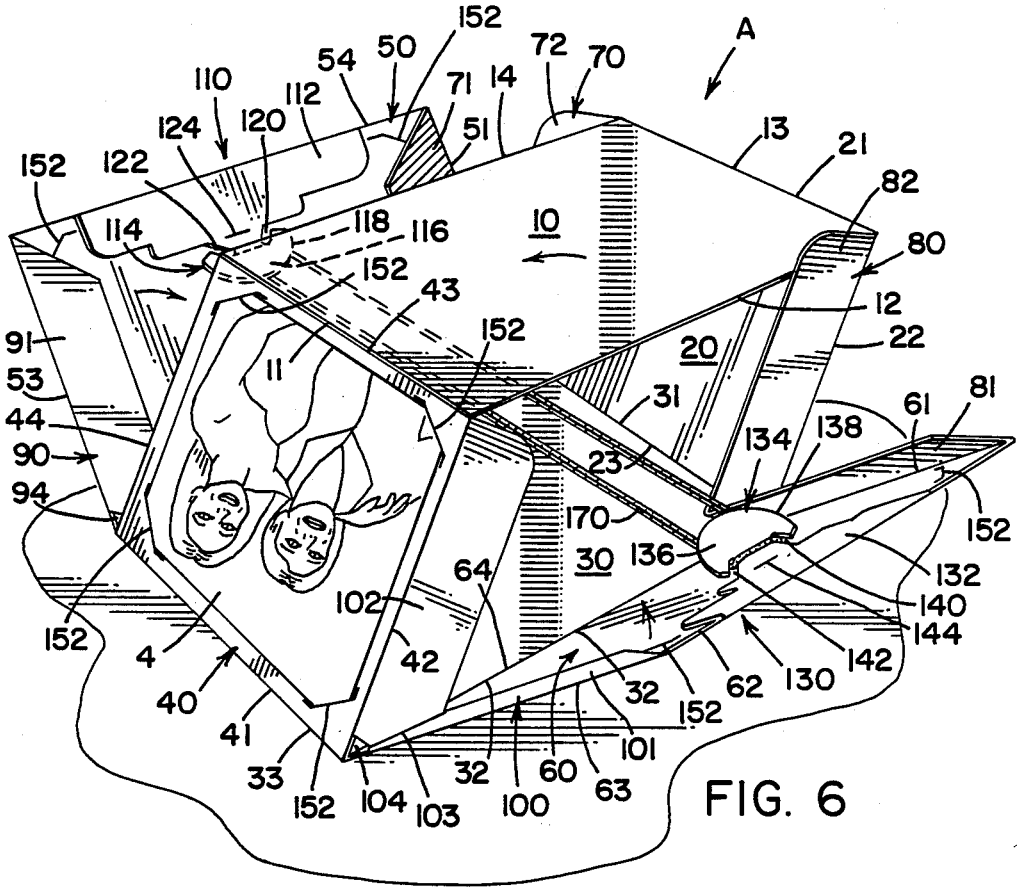
FIG. 6 is a view similar to FIG. 1 but showing the display device in the partially flattened configuration in preparation for stowage in an envelope.

An elastic band 170 is passed around left hook panel 114 engaging the undercut recesses 120, 122, under band panels 10, 40 and over band panels 20, 30 and into engagement with the undercut recesses 140, 142 of the right hook panel 134. The elastic band 170 is shown in the engaged position in FIG. 6 and also in FIGS. 2, 3 and 4. As can be seen particularly clearly in FIG. 6, the elastic band 170 pulls the two hook panels 114, 134 toward one another, lifting the side panels 50, 60 upwardly and rotating them about their inward edges 52, 64. As the side panels 50, 60 rotate upwardly, the lower margins 90, 100 must move with respect to the lower band panel 40. As the score lines along the side edges 42, 44 of panel 40 are in the finish side of the blank B, they promote the vertical segments 92, 102 of the margins to rotate downwardly with respect to panel 40. The horizontal segments 91, 101 are glued to the side panels 50, 60 and cannot move with respect thereto. Therefore, the margins fold along the slits 93, 103 and the lower band panel 40 is urged to rotate around its bottom edge 41 in an upward direction. The upper band panel 10 is pulled along with the lower band panel 40 displacing the vertical segments 72, 82 of the margins 70, 80. The angle between the vertical segments 72, 82 and the horizontal segments 71, 81 of the margins is decreased by the action of the band panels and the rising of the side panels 50, 60 causing the upper margins 70, 80 to deform around slits 73, 83. FIG. 6 shows the folding or deformation caused as the side panels come up to about one half of their raised height. It can be seen that the margins 70, 80, 90, 100 stiffen the side panels 50, 60 and band panels 40, 20 during and after this erecting operation and encourage the end panels 10, 20, 30, 40 to form a right rectangular box. As the side panels 50, 60 finish their upward rotation, the band panels 10, 20, 30, 40 finish their erection into a box with the margin panels 71, 72, 81, 82, 91, 92, 101, 102 disappearing within the box formed resulting in the display of FIG. 1.

The desired folding described above can be encouraged by "training" the blank B to fold properly during assembly or first use.

Figure 2:
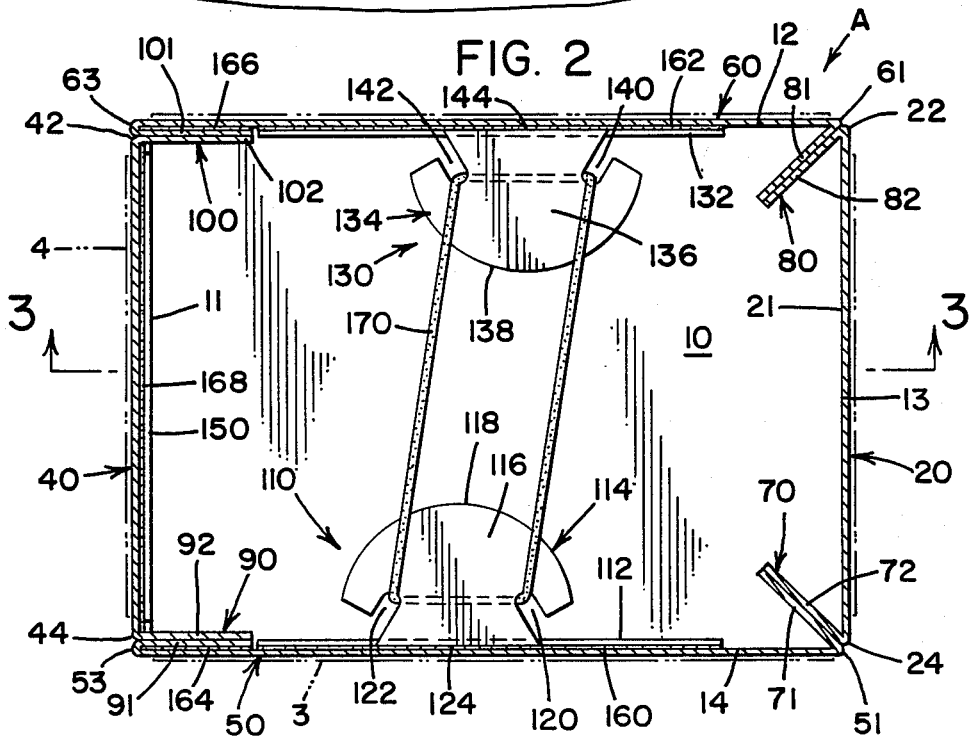
FIGS. 2 is a downwardly looking cross-sectional view taken along line 2—2 of FIG. 1 showing the internal arrangement of parts of the device.
Figure 3:
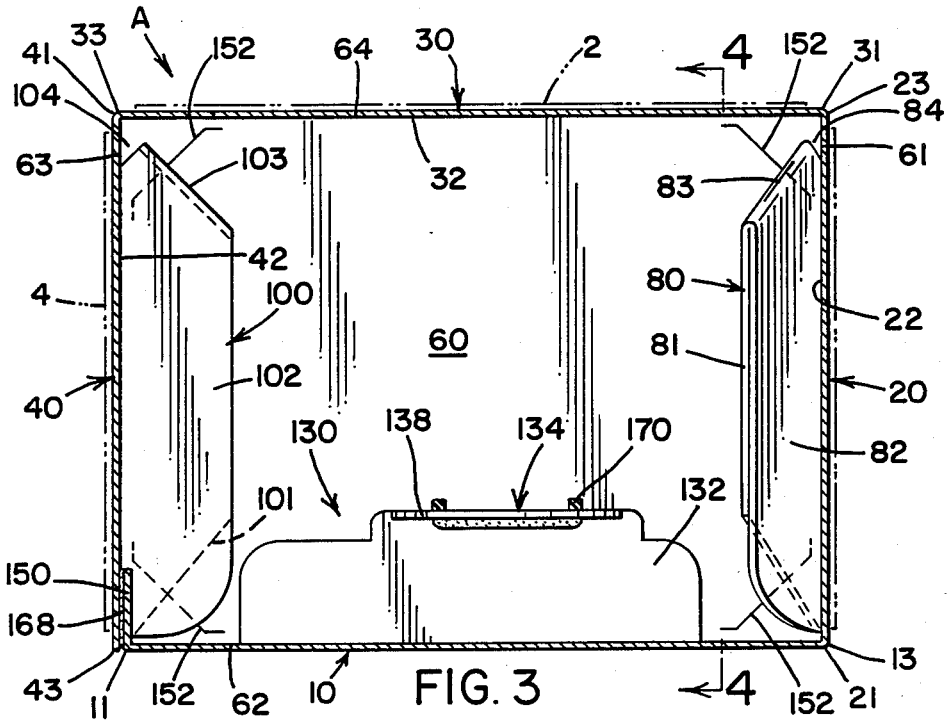
FIG. 3 is a cross-sectional view taken along line 3—3 of FIG. 2 and showing the inside parts of one side of the device.
Figure 4:
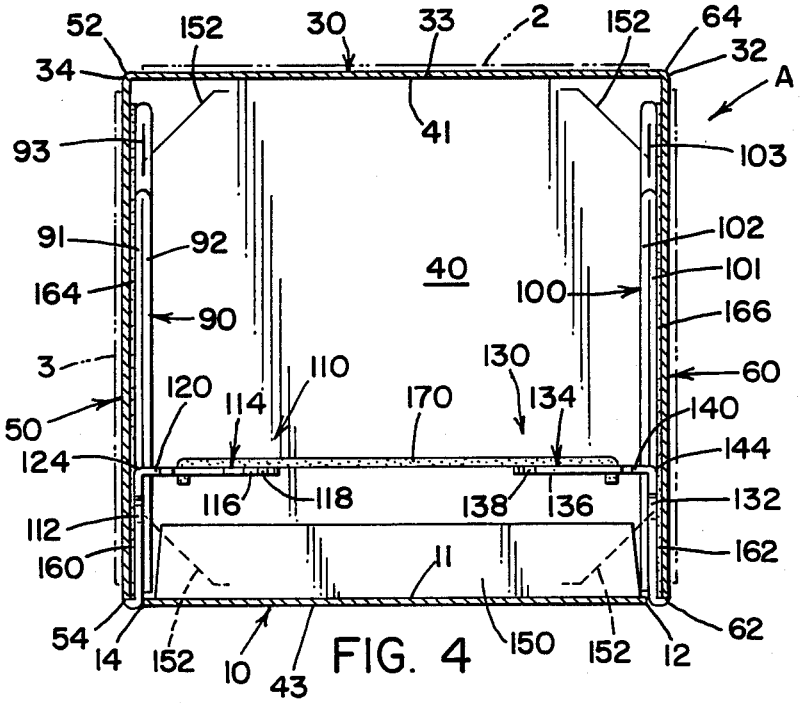
FIG. 4 is a cross-sectional view taken along line 4—4 of FIG. 3 and is orthogonal to FIG. 3 thus showing the interior parts of the device at an angle of 90° to the view of FIG. 3.

As can be seen in FIG. 2, the margins 70, 80, 90, 100 act as stiffeners maintaining the flat appearance of the outside panels upon which the photos are mounted. The margins 70, 80 which are not adhesively bound to the side panels 50, 60 are disposed at an angle of about 45° to the side panels and panel 20, thereby providing maximum stiffening. Margins 90, 100 stiffen panels 40, 50, 60. The triangular apertures 74, 84, 94, 104 facilitate the margins 70, 80, 90, 100 assuming their fully erected position by preventing the binding of material at the corners resulting in a bulge or incomplete closure. The positive results of this arrangement are best seen in FIG. 3. The positioning of the base 116 of the hook panel 114 about midway between the center of the left panel 50 and the left edge of the left panel 50 prevents bowing of the panel. The right hook panel 134 is similarly positioned on panel 60 resulting in a flatter display.

Figure 5:
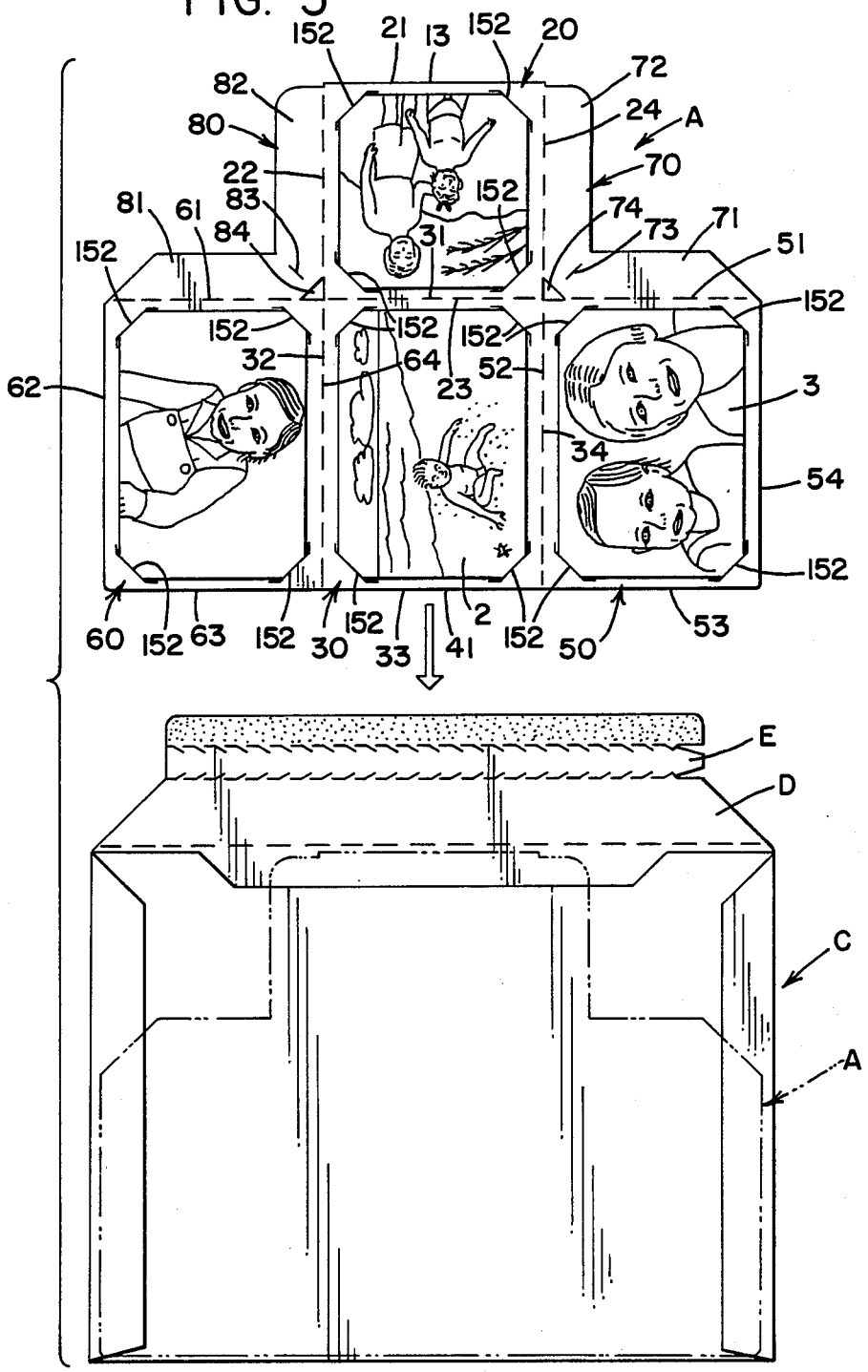
FIG. 5 is a view of the device of FIG. 1 in the collapsed configuration with photographs inserted in selected panels thereof ready to be inserted in an accompanying envelope which is also shown.

In practice, the cuboid photo display A is used by assembling selected photographs into the panels of the cuboid by tucking their corners into slits 152. The display A is then disposed in its collapsed configuration by pushing downwardly on panel 10 and then outwardly on panels 50 and 60. The flattened display, as seen in FIG. 5, is then simply slid into an appropriately sized paperboard envelope C. The envelope is addressed, sealed by folding over the flap B and mailed.

During transit, the display is maintained in the collapsed position by the pressure of the paperboard envelope. Upon receipt, the envelope is opened by pulling tear strip E and, as the display A is removed, it springs into its erected position as a finished photo cube displaying the pictures of interest.

The photo display device described can be used with photo in all the panels 10, 20, 30, 40, 50, 60 or any of a selected number of the panels as desired by the user. Photo retention slots 152 are shown in the preferred embodiment as only being placed in four of the panels but can be placed in different selected panels or all of the panels.

The display device described can be used a number of times by consumers by simply collapsing the device and placing it in an envelope for mailing to a selected recepient. Moreover, photos are easily removed and are placed as user desires and dictates.

The photo display A described is inexpensive to manufacture as it is fabricated from a single piece of paperboard to which only an adhesive and an elastic band 170 is added. The device is easily and inexpensively shipped and marketed as it is shipped and marketed in the collapsed state. Moreover, because of the simplicity of the device, adequate attention to detail can be inexpensively maintained resulting in an attractive, high quality yet inexpensive portable photo display.

The invention has been described with reference to a preferred embodiment. Obviously, modifications and alterations will occur to others upon the reading and understanding of the specification. It is our intention to include all such modifications and alterations insofar as they come within the scope of the appended claims or the equivalents thereof.

Having thus described our invention, we claim:

1. A self-erecting cuboid photo display device fabricated from thin sheet material comprising:

four rectangular band panels foldably connected to one another in an endless band including a first band panel and second and third band panels connected to said first band panel, said band having a first continuous edge and a second continuous edge;

a first rectangular side panel having four edges, one of said edges being connected to said first band panel at said first continuous edge and a pair of said edges extending perpendicularly to said continuous edge;

a second rectangular side panel having four edged, one of said edges being connected to said first band panel at said second continuous edge and a pair of said edges extending perpendicularly to said continuous edge;

a first margin means connecting said first side panel to said second band panel, said first margin means comprising a first L-shaped margin panel having a first elongated section extending along and foldably connected to said first side panel at one of said perpendicular edges and a second elongated section extending along and foldably connected to said second band panel at said continuous edge, said first elongated section being foldably connected to said second elongated section along an inwardly folding line oriented at 45° to said edges, and a first triangular aperture formed in said material having sides of said triangle defined by said one perpendicular edge and said continuous edge;

a second margin means connecting said second band panel to said second side panel, said second margin means comprising a second L-shaped margin panel formed in the mirror image of said first L-shaped margin panel including said inwardly folding line and being likewise foldably connected to said side and band panels, and including a second triangular aperture oppositely located in the mirror image of said first triangular aperture;

a third margin means connecting said second side panel to said third band panel, said third margin means comprising a third L-shaped margin panel formed in the mirror image of said second L-shaped margin panel including said inwardly folding line and being likewise foldably connected to said side and band panels, and including a third triangular aperture oppositely located in the mirror image of said second triangular aperture;

a fourth margin means connecting said third band panel to said first side panel, said fourth margin means comprising a fourth L-shaped margin panel formed in the mirror image of said third L-shaped margin panel including said inwardly folding line and being likewise foldably connected to said side and band panels, and including a fourth triangular aperture oppositely located in the mirror image of said third triangular aperture;

elastic band engagement means disposed on both said side panels;

an elastic band engaging both said engagement means thereby urging said side panels toward one another and said display device into the erected state, and said elastic band extending in a direction perpendicular to said continuous edges.

* * * * *